United States Patent [19]

Ettischer et al.

[11] Patent Number: 5,044,618

[45] Date of Patent: Sep. 3, 1991

[54] SHEET-HANDLING DEVICE

[75] Inventors: Helmut Ettischer, Ostfildern; Arno Ebner, Ammerbuch, both of Fed. Rep. of Germany

[73] Assignee: Eastman Kodak Company, Rochester, N.Y.

[21] Appl. No.: 509,274

[22] Filed: Apr. 16, 1990

[30] Foreign Application Priority Data

Jun. 7, 1989 [DE] Fed. Rep. of Germany ..... 3918579

[51] Int. Cl.[5] ..... B42B 1/02

[52] U.S. Cl. ..... 270/53; 270/58

[58] Field of Search ..... 270/37, 53, 58; 227/156

[56] References Cited

U.S. PATENT DOCUMENTS

| | | | |
|---|---|---|---|
| 4,878,656 | 11/1989 | Honjo | 270/53 |
| 4,905,055 | 2/1990 | Higaki | 270/53 |
| 4,946,154 | 8/1990 | Nakamura | 270/53 |

*Primary Examiner*—Edward K. Look
*Assistant Examiner*—Therese M. Newholm
*Attorney, Agent, or Firm*—Lawrence P. Kessler

[57] ABSTRACT

A housing (1) includes an upper tray (7) for receiving sheets which are not to be stapled, a lower tray (8) for receiving sheet stacks (35) which are stapled and an inclined tray (29) arranged in between and adapted for collecting and stapling sheets. The collecting tray (29) is arranged in a relatively steeply inclined position with respect to a stapling station (39) located at its lower end so that sheets entering the collecting tray (29) slide under the sole action of gravity automatically down to a movable blocking member (33) which limits the collecting tray (29). The collecting tray (29) is part of an assembly unit (13) which comprises all transport and guiding elements for feeding the sheets which enter an entrance area (5) either to the upper tray (7) or the collecting tray (29). Moreover, the assembly unit (13) supports all means required for producing sheet stacks and feeding out the finished sheet stacks. The assembly unit (13) is mounted on the housing (1) by means of lower stationary housing pins (59) and is fixed precisely in position by locking means (63, 64).

8 Claims, 1 Drawing Sheet

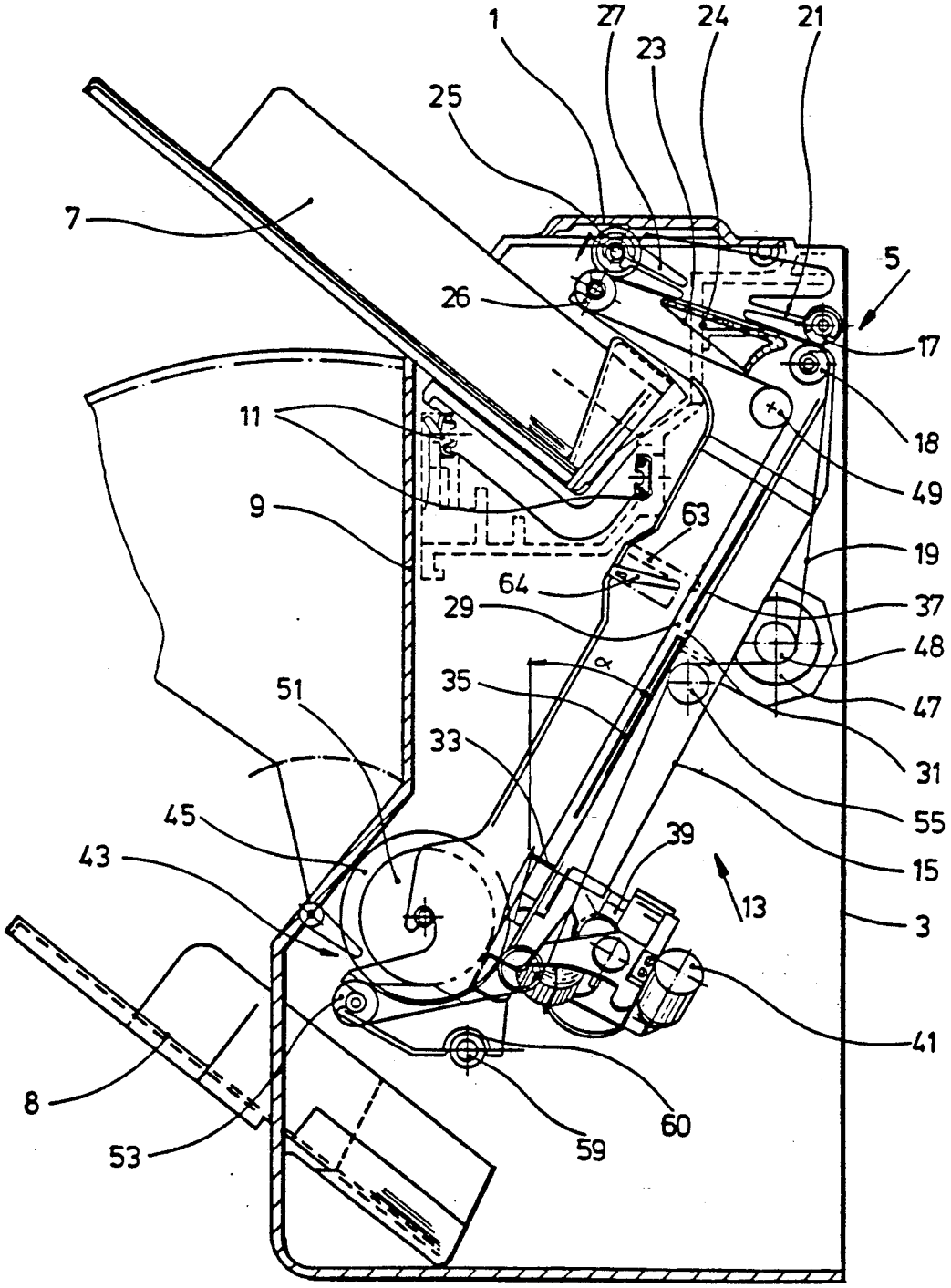
1
27
24
21
23
25
7
5
26
17
18
11
49
9
63
19
64
29
37
48
35
47
51
33
31
55
45
39
15
43
13
3
41
8
60
59
53

SHEET-HANDLING DEVICE

BACKGROUND OF THE INVENTION

The invention relates to a sheet-handling device with a tray arranged in a housing and adapted to receive sheets which are not to be stapled, a second tray provided in the housing for collecting sheets which are to be stapled, a stapling device associated with the second tray and driving and guiding means for selectively feeding sheets to either the first or the second tray.

Sheet-handling devices for receiving sheets which are to be stapled, or not to be stapled, are generally known; see, for example, EP 0122992A. Such devices are typically used as auxiliary equipment for copiers in order to selectively combine the copy sheets fed from the copier in either unstapled sheet stacks or stapled sheet stacks. However, such devices are large, complicated and expensive to manufacture and maintain.

SUMMARY OF THE INVENTION

It is the object of the invention to provide a sheet-handling device for receiving sheets which are to be stapled, or not to be stapled, which is easy and inexpensive to manufacture and, compared with known handling devices, is characterized by a particularly compact design.

In accordance with the invention, this object is attained in a sheet-handling device of the above-mentioned type in that one tray is combined with the stapling device and with the driving and guiding means to form an assembly unit which is connected with the device housing in an easily releasable manner. Since all functional elements essential to the sheet handling and the stapling of sheets collected in the one tray form an assembly unit which can be easily incorporated into the housing, such apparatus is particularly easy to assemble, which results in low manufacturing costs. At the same time, a particularly compact and space-saving design is obtained because the one tray forms the support for all functional elements of both the stapling device and the driving and guiding means. The total dimensions of the handling device are, therefore, considerably smaller than those of comparable known apparatus.

In the case of a preferred embodiment of the invention, the assembly unit is arranged in the housing such that the one tray is located below a deflecting member of the driving and guiding means, which is adjustable in position for selectively forming a sheet-transport path leading to either the one tray or another tray. The arrangement may be such that the bottom of the one tray is inclined with respect to the horizontal plane and, thus, makes possible sheet transport into the tray by the action of gravity. Accordingly, a particularly simple construction of the driving and guiding means for the sheets is obtained because the sheets to be collected in the one tray move automatically under the action of gravity along their further transport path after having passed the deflecting member, without driving members being required along that part of the transport path. Therefore, such embodiment of the device according to the invention is particularly inexpensive to produce.

The invention, and its objects and advantages, will become more apparent in the detailed description of the preferred embodiment presented below.

BRIEF DESCRIPTION OF THE DRAWINGS

The invention is explained in further detail in the following with reference to an embodiment illustrated in the accompanying drawing, in which:

The single FIGURE shows, in a schematic manner partially in a vertical sectional presentation, a lateral view of an embodiment of the handling device according to the invention without its lateral housing cover.

DESCRIPTION OF THE PREFERRED EMBODIMENT

In the illustrated embodiment of the sheet-handling device according to the invention, a housing 1 is provided which is open at a rear side 3. At that open side 3, the housing can be attached to an apparatus such as a copier (not illustrated) from which individual sheets can be fed sequentially into an entrance area 5 of the sheet-handling device. The housing 1 includes several trays for sheets such as an upper tray 7 and a lower tray 8 which are both manually accessible from outside at the front wall 9 of the device, opposite to the rear side 3. The upper tray 7 serves for collecting sheet stacks consisting of loosely deposited unstapled sheets. In order to allow sheet stacks formed to be superimposed with a lateral displacement, the upper tray 7 is horizontal shiftable along sliding guides 11 in a direction into the plane of the accompanying drawing. The lower tray 8 serves for collecting stapled sets of sheets.

In order that the sheets fed into the entrance area 5 can be selectively fed to either the upper tray 7 or the lower tray 8 and can be combined to form sets of sheets which are stapled before they are deposited in the lower tray 8, an assembly unit 13 is provided which extends in housing 1 in the area between upper tray 7 and lower tray 8. The assembly unit 13 comprises a box-shaped lower housing 15 consisting of plastic material and forming the support for all pertinent functional elements. The latter comprise means for forming a transport path for the sheets, which leads from the entrance area 5 to either the upper tray 7 or the lower tray 8, driving and guiding means by which the sheets can be selectively moved through either that part of the transport path which leads to tray 7 or to that part which leads to tray 8, as well as means for stapling the sheets in sets before they reach the lower tray 8.

The aforementioned driving and guiding means comprise, within the entrance area 5, the feeding device including pairs of cooperating upper and lower transport rollers 17 and 18, respectively. The lower rollers 18 are drivable by a belt 19 and the upper rollers are spring-biased into contact with the rollers 18 by flexible mounting arms 21 molded to housing 15. A deflecting member 23 is pivotally mounted about a journal 24 downstream of the rollers 17, 18 in the direction of transport of the sheets. The deflecting member, thus, can be pivoted counterclockwise from the position shown in the drawing, in which it clears the transport path from the entrance area 5 to the upper tray 7, to a position such that it deflects sheets from the entrance area 5 into the transport path leading to lower tray 8. In the position of the deflecting member 23 as illustrated in the drawing, the sheets move from the rollers 17, 18 to upper and lower exit rollers 25 and 26, respectively, adjacent to tray 7, of which, once again, the lower rollers 26 are drivable by belt 19 and the upper rollers 25 are spring-biased by means of flexible arms 27. The sheets moving out of the nip between the rollers 25, 26 are deposited in a superimposed arrangement in the upper tray 7.

Below the deflecting member 23, a collecting tray 29 is provided in the interior of the lower housing 15. The tray 29 serves to collect sheets which are to be stapled in sets before they are deposited in the lower tray 8. The collecting tray 29 is inclined in the direction of the main axis of the lower housing 15 and extends from an area below the entrance area 5 and the deflecting member 23 down to the lower tray 8. A surface 31 of the collecting tray 29 forms its bottom and serves as a contact surface for a stack of sheets which is to be stapled to form a set of sheets 35. The surface 31 has a relatively steep inclination with respect to the horizontal plane, the angle defined with the vertical plane (i.e., angle $\alpha$ according to the FIGURE) amounting to less than 45°. Therefore, when the deflecting member 23 has been changed from the position shown in the FIGURE to a position deflecting the sheets toward the collecting tray 29 and sheets are introduced into the upper side of the tray 29, they slide automatically down in tray 29 by the action of gravity because of the steep inclination of the inner surface 31. The sheets, thus, move automatically into contact with a movable blocking member 33. The blocking member 33 is selectively controlled by any suitable mechanism, such as an electromagnet, for example, so as to be retracted from its blocking position shown in the FIGURE to a clearing position when desired. Due to their contact with the blocking member 33, the sheets are aligned in the tray 29 to form a set 35 to be stapled.

In the upper entrance area of the collecting tray 29 is a deflecting ramp 37. The ramp 37 projects from the plane of the inner surface 31 thereof such that incoming sheets slide and are guided whereby each incoming sheet comes to rest upon the previously fed sheet of set 35. As such, the height of the ramp 37 is at least as large as the thickness of a sheet stack set 35 with the maximum number of sheets which can be collected in the tray 29 and stapled. For stapling the sets 35, a stapling station 39, designed in any suitable manner and drivable, for example, by a motor 41, is arranged in the vicinity of blocking member 33 at the lower end of tray 29 in an inclined position such that the sets 35 are respectively stapled in their marginal area adjacent to blocking member 33.

A feeding unit generally designated 43 is located in the transport path below blocking member 33. The unit 43 includes a transport drum 45 which is drivable, like the feeding rollers 18 and 26, by belt 19. The belt 19 is guided such that it extends from a belt disk 48 of a driving motor 47 via a belt disk associated with the driving rollers 18, a belt disk associated with the driving rollers 26, a deflecting disk 49, a belt disk 51 of the feeding unit 43, a belt disk for driving backing rollers 53 at the transport ramp 45 as well as a deflecting disk 55 back to the belt disk 48 of motor 47. The latter rotates counterclockwise when in operation, as seen in the FIGURE.

During operation, sheets fed to the entrance area 5 directly move to the upper tray 7 when the deflecting member 23 is in its position as shown in the FIGURE. The sheets drop into the tray 7 by their own weight as soon as the trailing sheet edge leaves the nip between the rollers 25 and 26. When the deflecting member 23 has been pivoted counterclockwise from its position shown in the FIGURE, the sheets transported by the rollers 17 and 18 are deflected downwardly. After the trailing sheet edge has left the rollers 17, 18 the sheets slide downwardly due to the inclination of the inner surface 31 of tray 29 and, after having passed ramp 37, move in a properly aligned position into contact with the blocking member 33. As soon as a sheet set 35 to be stapled has accumulated on the surface 31, the stapling station 39 is operated. Subsequently, blocking member 33 is retracted. As a result of the inclination of the inner surface 31, the stapled set 35 now slides further down under the action of gravity and comes into feeding engagement with drum 45 by which it is fed out in cooperation with the backing rollers 53. That is, the sheet set is moved into a position from which it drops into the lower tray 8 as soon as its trailing edge has been released from the transport nip between drum 45 and backing rollers 53.

Thanks to the inclination of the inner surface 31 of the collecting tray 29, no drive is required for transporting the sheets between deflecting member 23 and feeding unit 43 because transport is effected by the action of gravity. The remaining transport functions not caused by the action of gravity can be taken over by driving and guiding means of simple design so that these means, including the driving motor 47 and the belt 19, common to all transport functions are integrated into the assembly unit 13. Since the stapling station 39 and the deflecting member 23 are also part of the assembly unit, the sheet-handling apparatus can be very easily assembled by mounting the preassembled unit 13 in housing 1. The mounting operation is particularly easy if, as is the case in the present embodiment, mounting pins 59 are provided as mounting points in the housing 1. The pins 59 are positively engaged by mounting eyebolts 60 molded in the lower housing 15. Further, a snap lock is provided which includes snap hooks 63 resiliently attached to housing 1 snapping behind holding noses 64 on the lower housing 15. In order to assemble the unit, the snap lock need only be brought into its locking position. Release of the snap lock during disassembly of the unit 13 for servicing and repair purposes is equally easy.

The above description and the drawing are confined to features which are essential to illustrate an embodiment of the invention. Inasmuch as the features are disclosed in the description and in the drawing and not mentioned in the claims, they also serve, if necessary, for defining the subject matter of the invention.

We claim:

1. Sheet-handling device comprising:

a first tray (7) arranged in a housing (1) and adapted to receive sheets which are not to be stapled;

a second tray (29) provided in said housing (1) for collecting sheets which are to be stapled;

a stapling device (39) associated with said second tray (29); and driving and guiding means for selectively feeding sheets to either the first tray (7) or said second tray (29), said second tray (29) being combined with said stapling device (39) and with said driving and guiding means to form an assembly unit (13), and means for releasably locking said assembly unit (13) to said housing (1) such that said assembly unit (13) is connected with said housing (1) in an easily releasable manner.

2. Sheet-handling device according to claim 1, wherein said assembly unit (13) is arranged in said housing (1) such that said second tray (29) is located below a deflecting member (23) of said driving and guiding means, said deflecting member being adjustable so as to selectively provide a sheet-transport path which leads either to said first tray (7) or to said second tray (29); and wherein the bottom (31) of said second tray (29) is inclined toward the horizontal plane and the sheet transport in said second tray is thus made possible by the action of gravity.

3. Sheet-handling device according to claim 2, wherein said bottom (31) of said second tray (29) is inclined at an angle of more than 45° with respect to the horizontal plane.

4. Sheet-handling device according to claim 2, wherein the lower side wall of said second tray (29) is a blocking member (33) which is selectively movable into a releasing position in which it clears the path of transport of the sheets out of said second tray (29).

5. Sheet-handling device according to claim 4, wherein said stapling device (39) is arranged adjacent to said blocking member (33) and adapted for stapling a stack (35) in its marginal area adjacent to said blocking member (33).

6. Sheet-handling device according to claim 4, wherein said driving and guiding means include a feeding device (43) located on said assembly unit (13) below said blocking member (33) for feeding stapled sheet stacks (35), which are released when said blocking member (33) is moved from its blocking position to its releasing position, from said assembly unit (13).

7. Sheet-handling device according to claim 1, wherein said second tray (29) has a deflecting ramp (37), said ramp having a height which is at least as large as the thickness of a sheet stack set (35) with the maximum number of sheets which can be collected in said second tray (29).

8. Sheet-handling device according to claim 1, wherein said means for releasably locking said assembly unit (13) to said housing (1) includes a resilient snap lock (63, 64).

* * * * *